US006284015B1

(12) United States Patent
Ankudinov et al.

(10) Patent No.: US 6,284,015 B1
(45) Date of Patent: Sep. 4, 2001

(54) METHOD FOR PRODUCING MONO-DISPERSED SPHERICAL GRANULES

(75) Inventors: Vasily Borisovich Ankudinov, Podolsk; Maxim Gennadievich Klenov; Jury Alexandrovich Marukhin, both of Moscow; Vladimir Pavlovich Ogorodnikov, Podolsks, all of (RU)

(73) Assignee: Moskovsky Energetichesky Institut, Moscow (RU)

( * ) Notice: Subject to any disclaimer, the term of this patent is extended or adjusted under 35 U.S.C. 154(b) by 0 days.

(21) Appl. No.: 09/462,978

(22) PCT Filed: Mar. 28, 1998

(86) PCT No.: PCT/RU98/00158

§ 371 Date: Mar. 8, 2000

§ 102(e) Date: Mar. 8, 2000

(87) PCT Pub. No.: WO99/03625

PCT Pub. Date: Jan. 28, 1999

(30) Foreign Application Priority Data

Jul. 15, 1997 (RU) ..... 97112250

(51) Int. Cl.[7] ..... B22F 9/06
(52) U.S. Cl. ..... 75/331; 75/340
(58) Field of Search ..... 75/331, 338, 340

(56) References Cited

U.S. PATENT DOCUMENTS 4,818,279 * 4/1989 Chaleat et al. ..... 75/340
5,403,375 * 4/1995 König et al. ..... 75/255
5,445,666 * 8/1995 Peschka et al. ..... 75/338
5,480,470 * 1/1996 Miller et al. ..... 75/338

FOREIGN PATENT DOCUMENTS 532472 3/1977 (RU) .
2032498 4/1995 (RU) .

* cited by examiner

*Primary Examiner*—George Wyszomierski
(74) *Attorney, Agent, or Firm*—J. Herbert O'Toole; Hardaway/Mann IP Group

(57) ABSTRACT

The present invention relates to a method that comprises dispersing a stream of a melt flowing from a die by applying perturbations to said stream in an inert cooling gas which has an optimal temperature and is depleted of oxygen up to a value not exceeding 0.0001 mol. %. after their output at a stationary generation mode, the granules are recovered in the outlet portion of a heat-exchange chamber. The die is made of a heat-resistant material and has a flow section with a length defined by the relation 2d<1<20d. The perturbation frequency of the stream is defined by relation $$f=Wk_o/\pi d_o(1+c\tau)^2 \quad \text{(I)}$$

where $\tau$ is the dispersion time (at the initial moment $\tau=0$); c is the empirical coefficient characterizing the die material resistance to the perturbation of the stream; w is the flow rate of the stream; $d_o$ is the initial value of the stream diameter; and $k_o$ is equal to 0.7 and is the value of the non-dimensional wave number. The material to be dispersed consists of a chemically active melted metal or alloy that comprises at least one rare-earth element.

1 Claim, 2 Drawing Sheets

METHOD FOR PRODUCING MONO-DISPERSED SPHERICAL GRANULES

TECHNICAL FIELD

The present invention relates in general to powder metallurgy, more specifically to methods for preparing monodisperse materials used in regenerative heat exchangers, and has particular reference to a methods for preparing monodisperse spherical granules.

BACKGROUND ART

Known in the present state of the art is a method for preparing metal granules (SU, A, #532,472) by a forced capillary disintegration of a stream of melt under the action of regular perturbations. A device disclosed in the aforementioned reference operates by the method mentioned before. However, the method leaves out of account the thermal characteristics of the process which involves low quality of the resultant granules as to spherical shape and monodisperse nature thereof.

The closest to the proposed method is a method for preparing monodisperse spherical granules (RU, A, 2,032,498) which is based on the effect of forced capillary disintegration of a stream of melt under the action of perturbation applied thereto. The drops resultant from dispersion of said stream of melt are cooled, under optimum conditions, with an inert gas that fills the flight chamber. The prepared granules are taken out in the outlet section of the heat-exchanging chamber after the process has reached steady-state operating conditions of drop generation. When the stream of a chemically active melt flows through a die the surface of the flow-through orifice thereof gets eroded, whereby the die orifice diameter increases with time. This in turn results in that the stream diameter increases incessantly and the diameter of drops into which the stream is disintegrated.

Furthermore, the method under discussion suffers from a low quality of dispersed material obtained from dispersing chemically active melts to which, particularly, can be related rare-earth metals and alloys thereof.

DISCLOSURE OF THE INVENTION

It is a principal object of the present invention to provide a method for preparing monodisperse spherical granules which makes possible attaining higher quality of dispersed material resulting from dispersing chemically active melts so that the root-mean square (standard) deviation of the granule diameter from the preset value should be within 2% and the ratio between the greater and lesser granule diameters be within 1.02.

The foregoing object is accomplished due to the fact that in a known method for preparing monodisperse spherical granules, according to which the stream of melt outflowing from the die is dispersed under the effect of perturbations applied thereto at an optimum temperature of the cooling gas and the resultant granules are taken out in the outlet section of the heat-exchanging chamber after the process has reached steady-state operating conditions of drop generation, according to the invention, the inert gas is freed from oxygen to a maximum content of 0.0001 mol. %, the die is made of a refractory metal, and the length 'l' of the die flow section is within the range of 2d<1<20d, while the stream perturbation frequency is selected from the relationship:

$$f=Wk_o/\pi d_o(1+c\tau)^2$$

where:

- $\tau$—is the dispersion time (equal to zero at the initial instant of time),
- c—is the empirical coefficient characteristic of the die material resistance to the effect of stream perturbation,
- w—is the stream outflow velocity,
- $d_o$—is the initial stream diameter value,
- $k_o$—is the initial value (0.7) of the dimensionless wave number, use being made of a material subjected to dispersion comprising at least one of the following rare-earth metals: Y, La, Ce, Pr, Nd, Pm, Sm, Eu, Gd, Tb, Dy, Ho, Er, Tm, Yb.

In what follows the present invention will now be disclosed in a detailed description of an illustrative embodiment thereof with reference to the accompanying drawings, wherein.

BEST METHOD OF CARRYING OUT THE INVENTION

Figure 1:
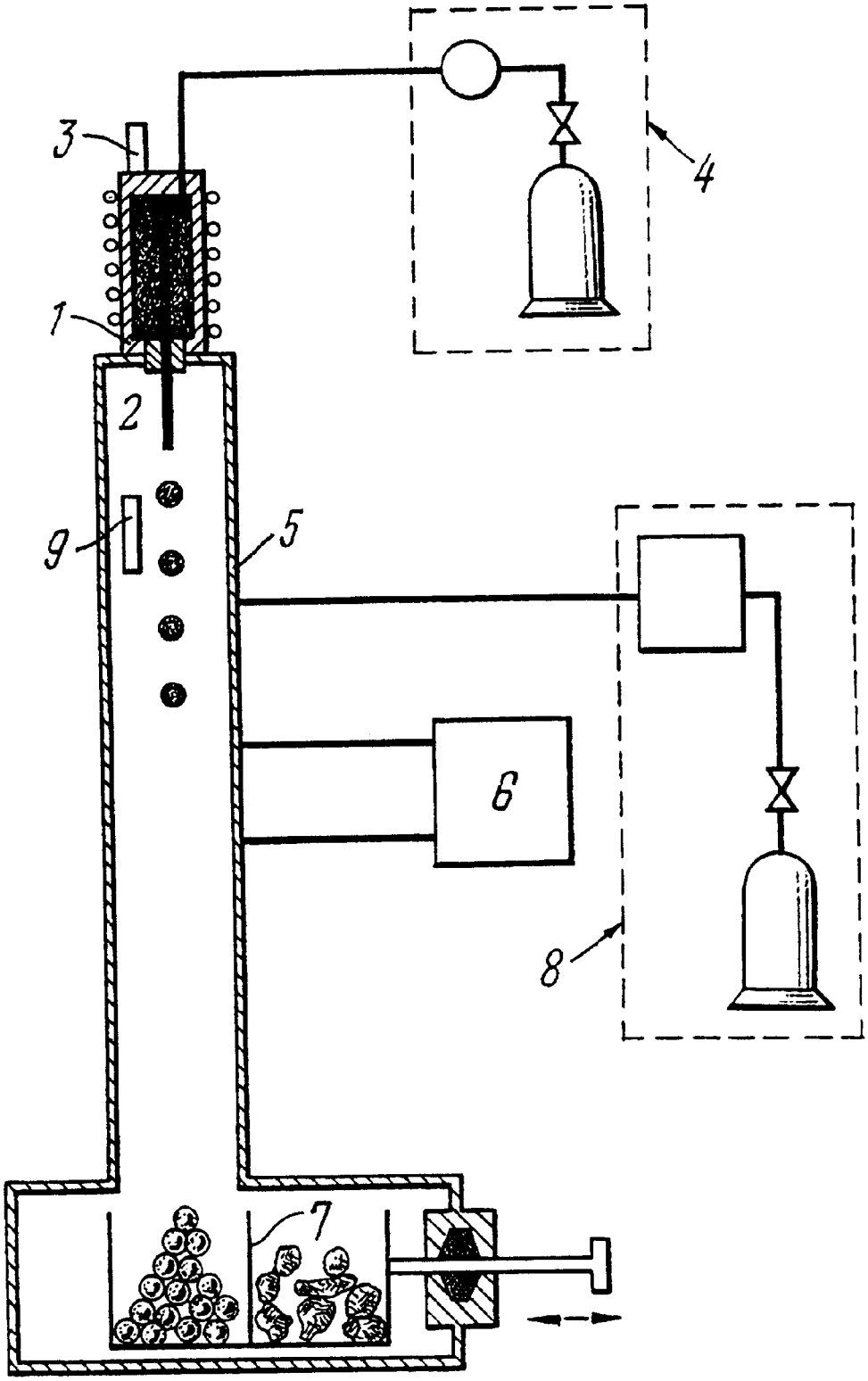
FIG. 1 is a device that carries into effect the herein-proposed method, according to the invention.
Figure 2:
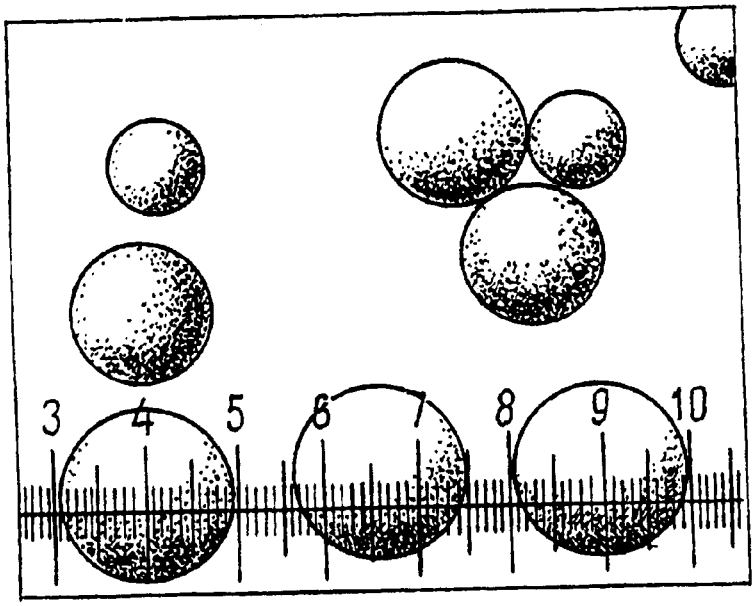
FIG. 2 shows granules prepared from $Er_3Ni$ at a constant melt stream perturbation frequency.
Figure 3:
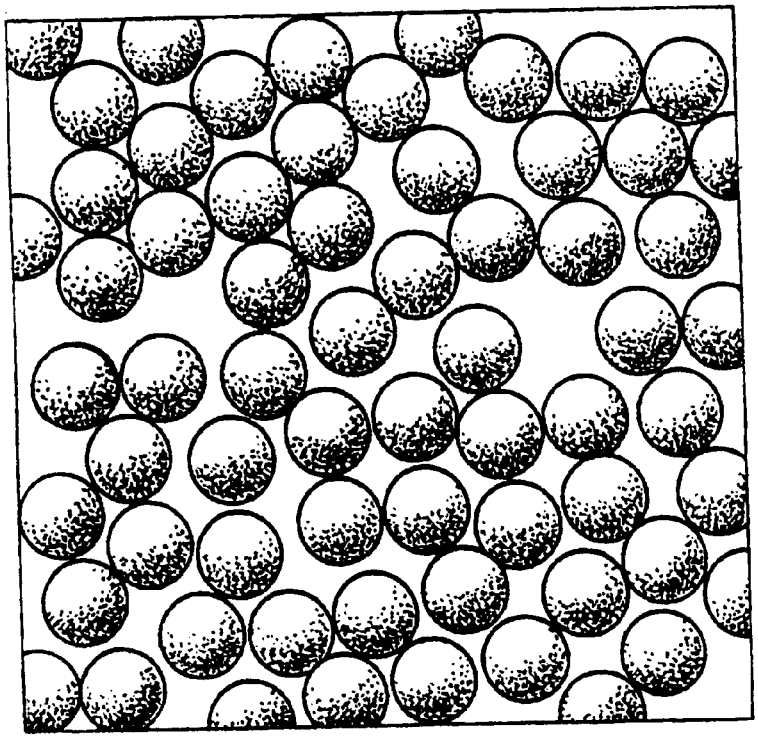
FIG. 3 shows granules prepared from $Er_3Ni$ at a melt stream perturbation frequency changed according to the proposed ratio.

The device carrying into effect the herein-proposed method comprises a heatable crucible 1 and a die 2 fixed in place at the bottom thereof, a stream perturbation unit 3, a melt pressure-applying unit 4, a heat-exchanging chamber 5, a coolant gas temperature regulator 6, a granule separator 7, a coolant gas purifier 8, and a granule size monitor 9.

The device operates as follows. The heat-exchanging chamber 5 and the granule separator 7 are filled, through the coolant gas purifier 8, with an inert gas having the oxygen content not in excess of 0.0001 mol. %. The metal ingots to be dispersed are melted down. A streamlined flow of the resultant melt is established using the melt pressure-applying unit 4. The stream of melt is exposed to the effect of perturbation for said stream to disintegrate at the following frequency:

$$f=Wk_o/\pi d_o(1+c\tau)^2$$

where:

- $\tau$—is the dispersion time (equal to zero at the initial instant of time),
- $d_o$—is the initial stream diameter value,
- w—is the stream outflow velocity,
- $k_o$—is the initial value (0.7) of the dimensionless wave number (cf. J. W. Rayleigh, "The Theory of Sound", v.2) which is realized at the initial period of the granulation process. Within the starting period of the device the resultant granules are collected in an auxiliary container of the separator 7. Once the steady-state drop generation conditions have set in, the main container of the separator 7 is filled with the granules obtained. The size of the resultant drops is monitored using the fiber-optic granule size monitor 9.

In the device realizing the proposed method for granulating chemically active melts the heat-exchanging chamber 5 is filled with helium having the oxygen content not over 0.0001 mol. %. With a higher oxygen content of helium the proposed granulation method is impracticable because a stabilizing oxide film is formed on the stream surface which prevents stream disintegration into drops.

Reaction between the stream of a chemically active melt and the material of the die 2 results inflicts erosion upon the orifice of the die 2. It is common knowledge that there exist no materials absolutely resistant to the action of melts of rare-earth metals. It is refractory metals (molybdenum, tantalum, tungsten) that can be regarded as the materials most resistant to such action. However, even in the case of said refractory metals the material of the die 2 is subject to time-dependent erosion, whereby its orifice is increased by up to 50% for 30 min.

It is found experimentally that when a chemically active melt outflows from the die 2, an optimum length of the die orifice is within the range of 2d<1<20d. The lower limit is defined by an abrupt rise of the rate of erosion of shorter die orifices, while the lower limit is concerned with the fact that a velocity profile is formed on a stream outflowing from a longer die orifice which tells unfavorably on stability of the process of forced capillary disintegration of a stream of melt.

It is due to erosion of the flow section of the die 2 that the resultant granules are polydispersed ones. Deterioration of the quality of disperse material concerned with a time-dependent increase of the stream diameter can be eliminated by properly adjusting the operating conditions of the device (i.e., the flow velocity and perturbation frequency of a stream). With a higher stream perturbation frequency the diameter of drops gets time-stabilized at a preset level. Time dependence of a change in the stream perturbation frequency can be obtained from consideration of an equality between the volume of a drop and the length of stream from which said drop is formed:

$$\pi d^2/4\times w/f=\pi d^3/6 \quad (1)$$

where D is the drop diameter. From (1) we obtain:

$$f=3wd^2/2D^3. \quad (2)$$

As experience has shown, time-dependent changes in the diameter of orifice of the die 2 is well described by the linear relationship:

$$d/d_o=1+c\tau \quad (3)$$

where:

$d_o$ is the initial value of the die orifice diameter ($\tau$=0), d is the value of said diameter at the time instant $\tau$, c is the empirical coefficient characteristic of the resistance offered by the material of the die 2 to the action of the melt.

Hydrodynamic resistance of the die 2 is defined largely by a local flow constriction resistance which is but little dependent on the orifice diameter. Therefore the stream velocity may be assumed constant, with an error on the order of 1% which is practically quite sufficient. Taking account of the above-said and using (2) and (2) a condition for regulating the stream perturbation frequency is derived, which, when fulfilled, ensures constant diameter of the resultant drops:

$$f=f_o(1+c\tau)^2 \quad (4)$$

where:

$f_o=k_o w/\pi d_o$—is the stream perturbation frequency at the initial instant of time $\tau$=0. Stream perturbation at the initial instant of time is effected with the wave number $k_o$=0.7 which corresponds to the range of maximum stream instability [3].

It is noteworthy that monodispersing of a melt stream having a time-increased diameter under conditions of perturbation frequency correction may be carried out within a restricted period of time, that is, until the dimensionless wave number 'k' exceeds unity. In the range of k>1 the stream gets hydrodynamically stable so that the effect of forced capillary disintegration of the stream on which is based the granulating techniques proposed herein, is degenerated.

The data on the techniques of preparing a monodisperse material from the alloy of $Er_3Ni$ used in regenerators of cryogenic gas machines are tabulated below. The table contains the following data: $d_o$—initial value of the orifice diameter in the die 2; $d_f$—finite value of said orifice diameter; $\tau_f$—duration of the granulating process; P—excess pressure in the crucible; w—stream velocity; $f_o$—initial stream perturbation frequency; c—empirical coefficient used for determining stream perturbation frequency; x—concentration of oxygen in helium; $T_1$—melt temperature; $T_2$—coolant gas temperature; D—diameter of the resultant granules; $\delta_1$—root-mean square (standard) deviation of the granule diameter from the preset value; $\delta_2$—maximum value of the ratio between the greater and lesser granule diameters.

TABLE

| $d_o$ $\mu$ | $D_f$ $\mu$ | $\tau_f$ s | P Mpa | w m/s | $f_o$ l/c | C l/c | x mol % | $T_1$ K | $T_2$ K | D $\mu$ | $\delta_1$ % | $\delta_2$ % |
|---|---|---|---|---|---|---|---|---|---|---|---|---|
| 80 | 104 | 1400 | 0.54 | 3.5 | 9800 | 2E−4 | 8E−5 | 1173 | 450 | 150 | 1.5 | 1.01 |

INDUSTRIAL APPLICABILITY

The present invention can find application for preparing monodisperse material used in regenerative heat exchangers.

What is claimed is:

1. A method for the preparation of monodisperse spherical granules comprising at least one rare-earth metal selected from the group consisting of Y, La, Ce, Pr, Nd, Pm, Sm, Eu, Gd, Tb, Dy, Ho, Er, Tm and Yb comprising:

melting the metal to be prepared as spherical granules in a crucible to form a melt;

establishing a perturbation in the melt;

forcing the melt under a variable head of pressure through a die at the base of the crucible into a heat-exchanging chamber, said die being formed from a refractory metal and having a length between 2 and 20 times its diameter whereby droplets are formed by the melt exiting the die;

cooling said heat-exchanging chamber with a cooled, purified inert gas having an oxygen content less than or equal to 1.0×10−4 mol. %;

monitoring the size of the droplets in the chamber; and collecting the granules at the bottom of the chamber;

wherein the stream perturbation frequency f defined by equation (1):

$$f=Wk_o/\pi d_o(1+c\tau)^2 \quad (1)$$

where:

τ—is the dispersion time (equal to zero at the initial instant of time), c—is the empirical coefficient characteristic of the die material resistance to the effect of stream perturbation, w—is the stream outflow velocity, $d_o$ is the initial stream diameter value, $k_o$—is the initial value (0.7) of the dimensionless wave number is adjusted to maintain monodisperse spherical granules in response to the monitored size of the droplet.

* * * * *